US011088486B2

(12) United States Patent
Maesoba et al.

(10) Patent No.: US 11,088,486 B2
(45) Date of Patent: Aug. 10, 2021

(54) SHIELD TERMINAL AND SHIELD CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 144 days.

(21) Appl. No.: 16/492,470

(22) PCT Filed: Feb. 20, 2018

(86) PCT No.: PCT/JP2018/005821
§ 371 (c)(1),
(2) Date: Sep. 9, 2019

(87) PCT Pub. No.: WO2018/163787
PCT Pub. Date: Sep. 13, 2018

(65) Prior Publication Data

US 2021/0151923 A1 May 20, 2021

(30) Foreign Application Priority Data

Mar. 10, 2017 (JP) ..... JP2017-045880

(51) Int. Cl.
*H01R 13/436* (2006.01)
*H01R 13/424* (2006.01)
(Continued)

(52) U.S. Cl.
CPC ..... *H01R 13/4362* (2013.01); *H01R 13/424* (2013.01); *H01R 13/4365* (2013.01);
(Continued)

(58) Field of Classification Search
CPC ..... H01R 13/4362; H01R 13/424; H01R 13/4365; H01R 13/6581; H01R 13/5202; H01R 13/6593; H01R 2201/26
(Continued)

(56) References Cited

U.S. PATENT DOCUMENTS 3,188,600 A * 6/1965 Woofter ..... H01R 13/28 439/290
7,867,033 B2 * 1/2011 Kumagai ..... H01R 25/006 439/620.01
(Continued)

FOREIGN PATENT DOCUMENTS

JP 61-133979 8/1986
JP 10-162888 6/1988
(Continued)

OTHER PUBLICATIONS

International Search Report dated Apr. 24, 2018.

*Primary Examiner* — Peter G Leigh
(74) *Attorney, Agent, or Firm* — Gerald E. Hespos; Michael J. Porco; Matthew T. Hespos

(57) ABSTRACT

A shield terminal (30) includes inner conductors (32), a dielectric (37) configured to accommodate the inner conductors (32) and an outer conductor (40) surrounding the dielectric (37), and is selectively mountable into a first housing (10) and a second housing (20). A first locking portion (49) and a second locking portion (55) are formed on an outer surface of the outer conductor (40). The shield terminal (30) inserted into a first accommodation chamber (13) is retained by a front retainer (17) restricting the resilient deflection of a first locking lance (14) and the first locking portion (49) being locked to the first locking lance (14). The shield terminal (30) inserted into a second accommodation chamber (21) is retained by the locking of the first
(Continued)

locking portion (49) and a second locking lance (22) and the locking of the second locking portion (55) and a side retainer (25).

4 Claims, 12 Drawing Sheets

(51) Int. Cl.
*H01R 13/6581* (2011.01)
*H01R 13/52* (2006.01)
*H01R 13/6593* (2011.01)

(52) U.S. Cl.
CPC ..... *H01R 13/6581* (2013.01); *H01R 13/5202* (2013.01); *H01R 13/6593* (2013.01); *H01R 2201/26* (2013.01)

(58) Field of Classification Search
USPC ..... 439/607.58
See application file for complete search history.

(56) References Cited

U.S. PATENT DOCUMENTS

| | | | | |
|---|---|---|---|---|
| 9,004,955 | B2 * | 4/2015 | Frank | H01R 13/14 439/750 |
| 2014/0045378 | A1 * | 2/2014 | Kawashima | H01R 13/506 439/607.58 |
| 2015/0155670 | A1 | 6/2015 | Gardner | |
| 2018/0254579 | A1 * | 9/2018 | Miyamura | H01R 13/533 |
| 2018/0261945 | A1 * | 9/2018 | Maesoba | H01R 13/422 |
| 2020/0083633 | A1 * | 3/2020 | Maesoba | H01R 13/113 |
| 2020/0136294 | A1 * | 4/2020 | Maesoba | H01R 13/4364 |
| 2020/0212617 | A1 * | 7/2020 | Miyamura | H01R 13/4223 |

FOREIGN PATENT DOCUMENTS

| | | |
|---|---|---|
| JP | 7-176342 | 7/1995 |
| JP | 10-321280 | 4/1998 |
| JP | 2002-319456 | 10/2002 |
| JP | 2012-129103 | 7/2012 |
| JP | 2013-125585 | 6/2013 |
| JP | 2015-537327 | 12/2015 |

* cited by examiner

SHIELD TERMINAL AND SHIELD CONNECTOR

BACKGROUND

Field of the Invention

The invention relates to a shield terminal and a shield connector.

Related Art

Japanese Unexamined Patent Publication No. 2012-129103 discloses a shield connector with a terminal unit that has an inner conductor terminal in a dielectric. An outer conductor forms a shield terminal by surrounding the terminal unit and a housing accommodates the shield terminal. A resiliently deflectable locking lance is formed in the housing and is locked to a locking projection formed on an outer surface of the outer conductor for retaining and holding the shield terminal in the housing.

There is a concern that the resiliently deflectable locking lance may be disengaged from the locking projection due to an impact, vibration or the like. Thus, it is desired to improve the reliability of a function for retaining the shield terminal.

The invention was completed on the basis of the above situation and aims to improve the reliability of a function for retaining a shield terminal.

SUMMARY

A first aspect of the invention is directed to a shield terminal with an inner conductor, a dielectric configured to accommodate the inner conductor, and an outer conductor surrounding the dielectric. The shield terminal is mountable into a selected one of a first housing and a second housing. The first housing includes a resiliently deflectable first locking lance, a front retainer capable of restricting resilient deflection of the first locking lance and a first accommodation chamber. The second housing includes a resiliently deflectable second locking lance, a second accommodation chamber and a side retainer facing inside of the second accommodation chamber. A first locking portion and a second locking portion are formed on an outer surface of the outer conductor. The shield terminal that is inserted into the first accommodating chamber is retained by the front retainer restricting the resilient deflection of the first locking lance and the first locking portion being locked to the first locking lance. The shield terminal that is inserted into the second accommodating chamber is retained by locking the first locking portion and the second locking lance and by locking the second locking portion and the side retainer.

A second aspect of the invention is directed to a shield connector with a shield terminal having an inner conductor accommodated in a dielectric and having the dielectric surrounded by an outer conductor. The shield connector is configured by inserting the shield terminal into a selected one of a first accommodation chamber formed in a first housing and a second accommodation chamber formed in a second housing. A resiliently deflectable first locking lance is formed in the first accommodation chamber, and a front retainer that is configured to restrict resilient deflection of the first locking lance can be mounted into the first housing. The shield connector also includes a resiliently deflectable second locking lance formed in the second accommodation chamber, and a side retainer can be mounted into the second housing to face the inside of the second accommodation chamber. A first locking portion is formed on an outer surface of the outer conductor and is configured to retain the shield terminal by being locked to the first locking lance when the shield terminal is inserted into the first accommodation chamber and is configured to retain the shield terminal by being locked to the second locking lance when the shield terminal is inserted into the second accommodation chamber. A second locking portion is formed on the outer surface of the outer conductor and is configured to retain the shield terminal by being locked to the side retainer when the shield terminal is inserted into the second accommodation chamber.

When the shield terminal is inserted into the first accommodation chamber, the first locking portion is locked to the first locking lance and the front retainer is mounted into the first housing to restrict the resilient deflection of the locking lance so that the shield terminal can be retained reliably. When the shield terminal is inserted into the second accommodation chamber, the first locking portion is locked to the second locking lance and the side retainer is locked to the second locking portion so that the shield terminal can be retained reliably. Thus, the shield terminal can be used as a common member for the first and second housings of different types.

The first locking portion and the second locking portion may be disposed in regions of the outer surface of the outer conductor on opposite sides in a direction intersecting an inserting direction into the first accommodation chamber and the second accommodation chamber. According to this configuration, the first and second locking portions are disposed in different regions. Thus, a degree of freedom in design, such as the shapes and arrangements of the first and second locking portions, is high.

A front stop may be formed in the region of the outer surface of the outer conductor where the second locking portion is disposed and may be configured to restrict a movement of the shield terminal inserted into the first accommodation chamber or the second accommodation chamber beyond a proper insertion position. According to this configuration, the first locking lance and the second locking lance do not resiliently come into contact with the region where the second locking portion is formed. Thus, the front stop does not generate insertion resistance due to resilient interference with the first or second locking lance.

DETAILED DESCRIPTION

An embodiment of the invention is described with reference to FIGS. 1 to 13. Note that, in the following description, a left side in FIGS. 1 to 4 and 6 to 13 is defined as a front side concerning a front-rear direction. Upper and lower sides shown in FIGS. 1 to 4 and 6 to 12 are directly defined as upper and lower sides concerning a vertical direction.

A shield terminal 30 of this embodiment constitutes a first shield connector A (shield connector as claimed) of a waterproof type by being mounted into a first housing 10 and constitutes a second shield connector B (shield connector as claimed) of a non-waterproof type by being mounted into a second housing 20.

Figure 7:
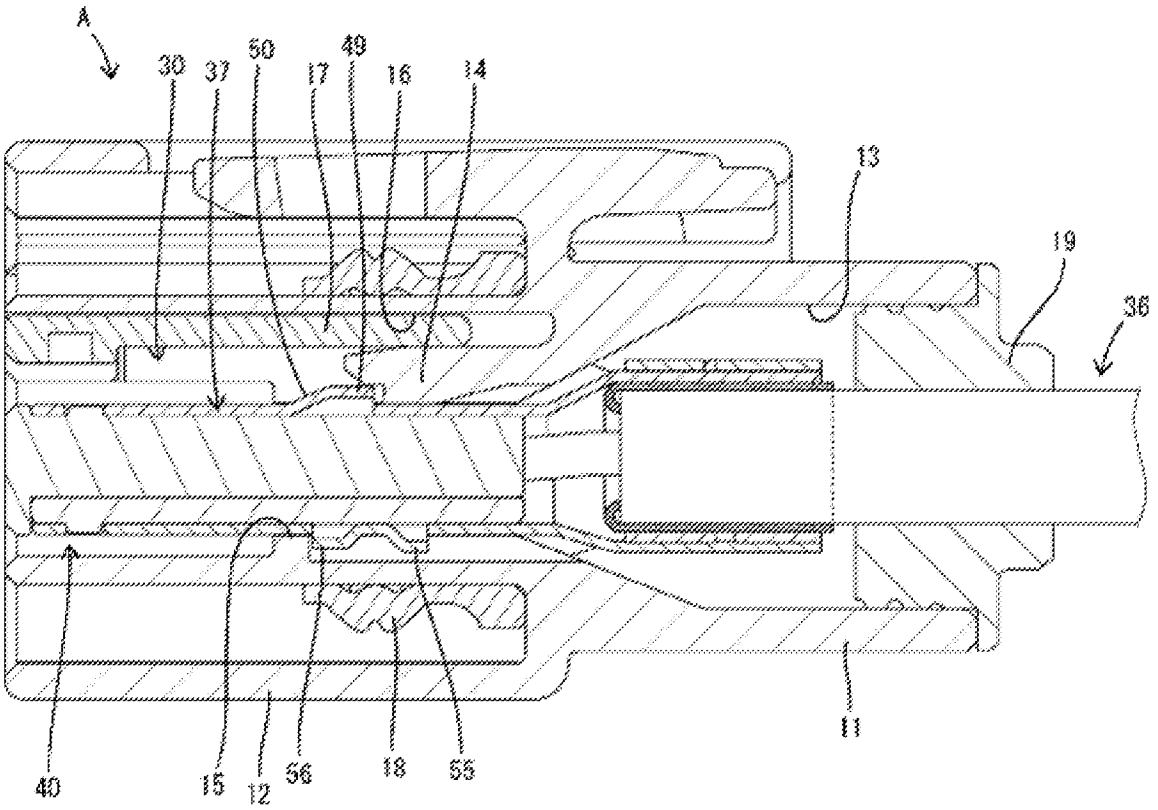
FIG. 7 is a side view in section showing a state where a front retainer is at a full locking position in the first shield connector.
Figure 8:
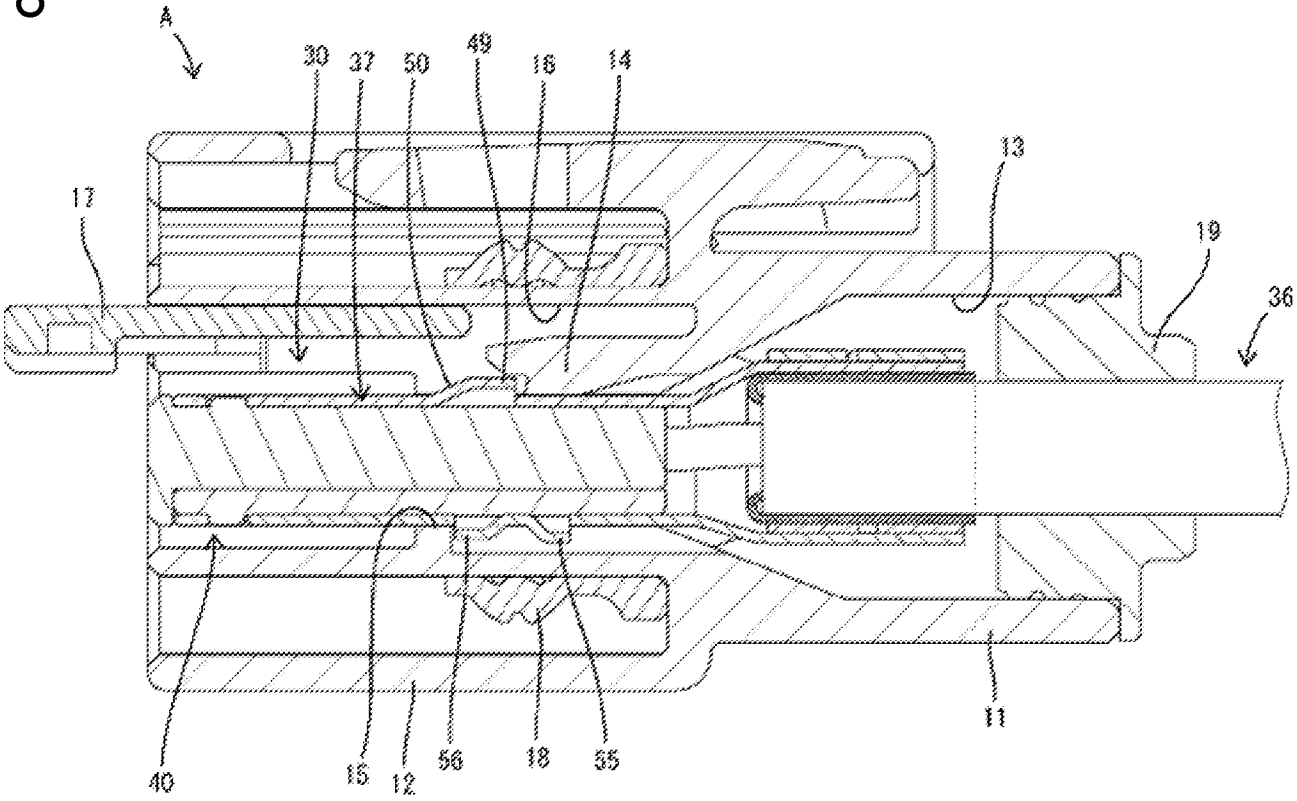
FIG. 8 is a side view in section showing a state where the front retainer is at a partial locking position in the first shield connector.
Figure 9:
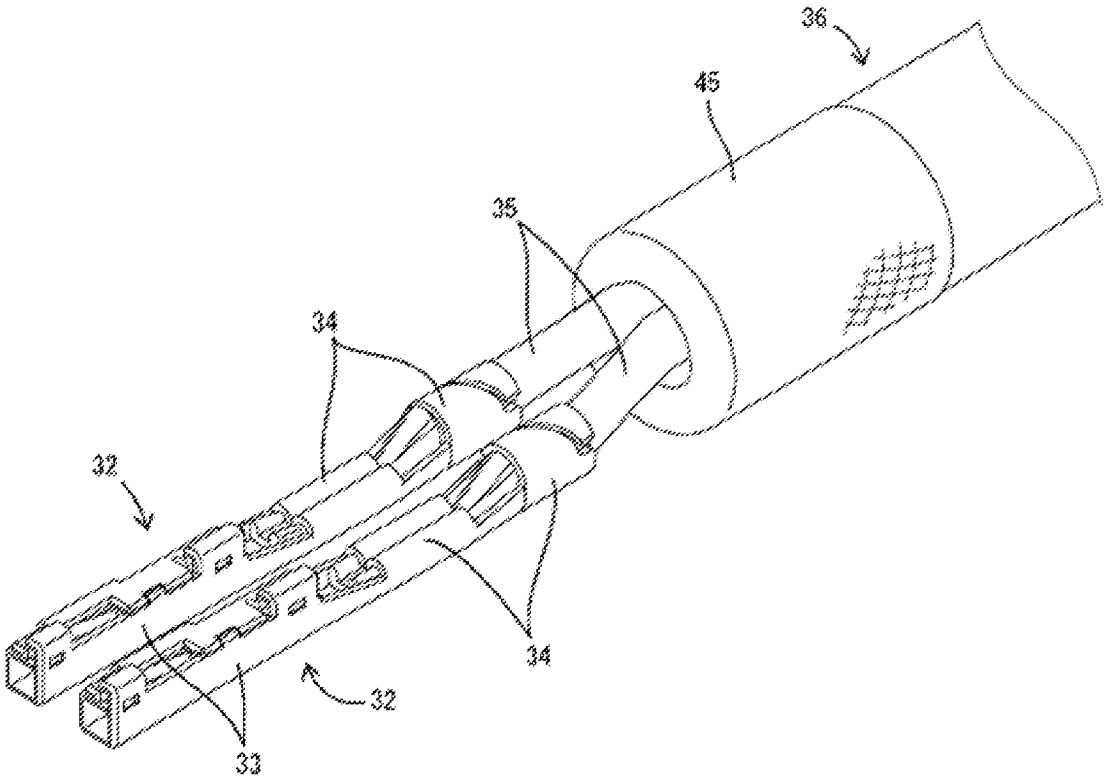
FIG. 9 is a perspective view showing a state where inner conductors are connected to a twisted pair cable.
Figure 10:
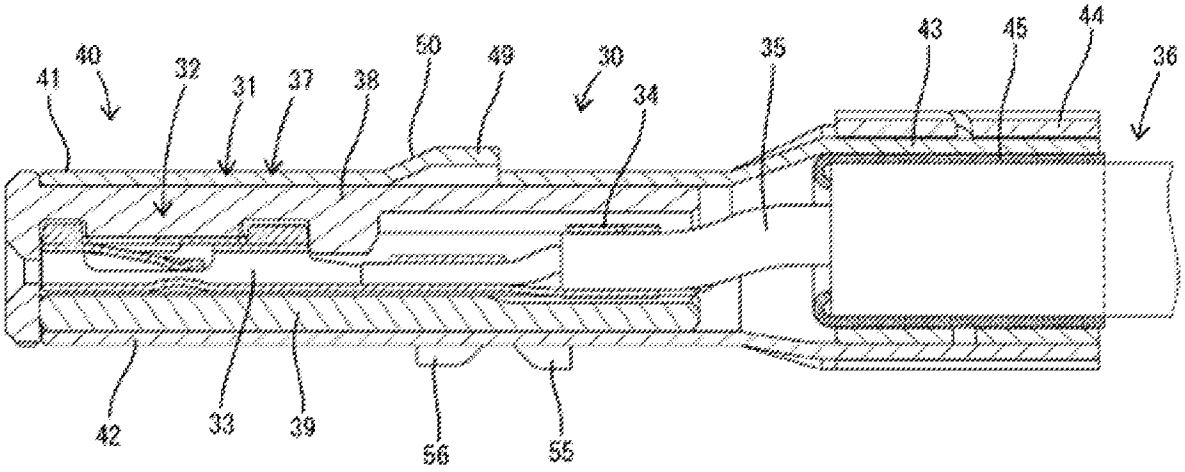
FIG. 10 is a side view in section of the shield terminal.
Figure 11:
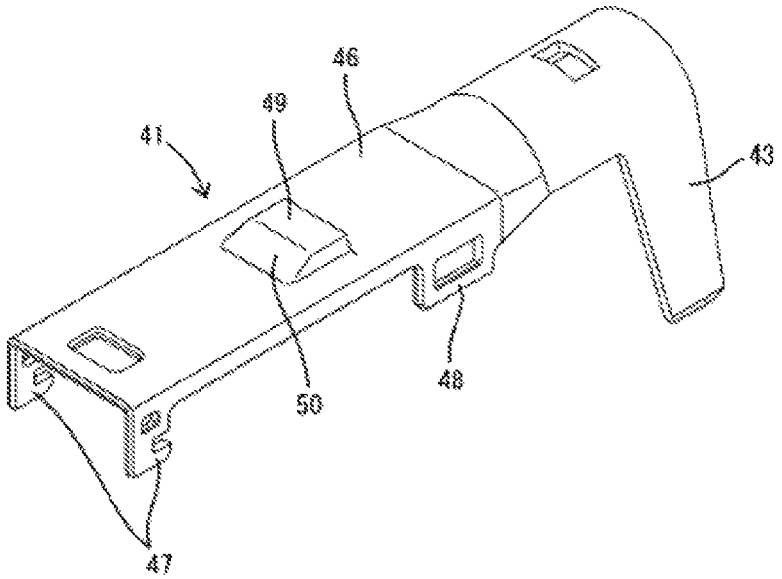
FIG. 11 is a perspective view of a first shell.
Figure 12:
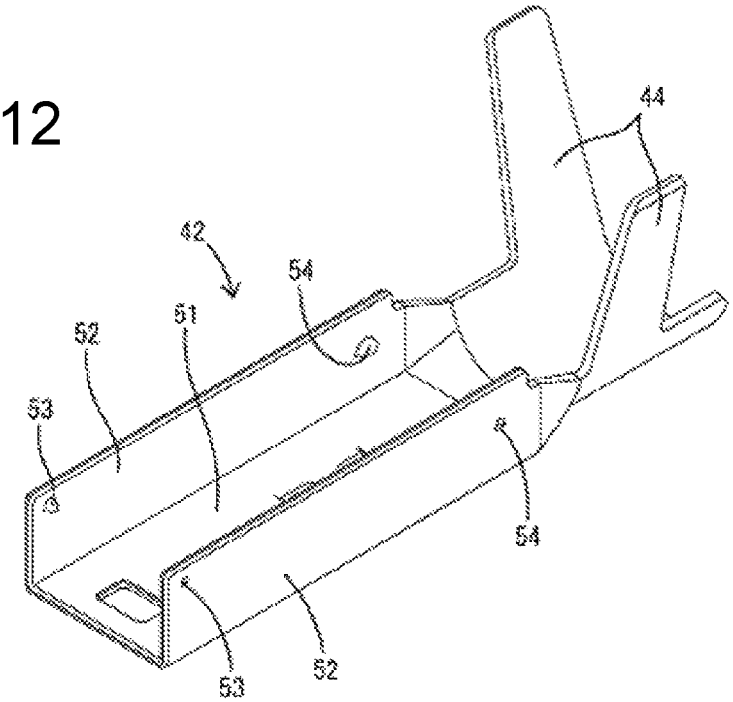
FIG. 12 is a perspective view of a second shell.
Figure 13:
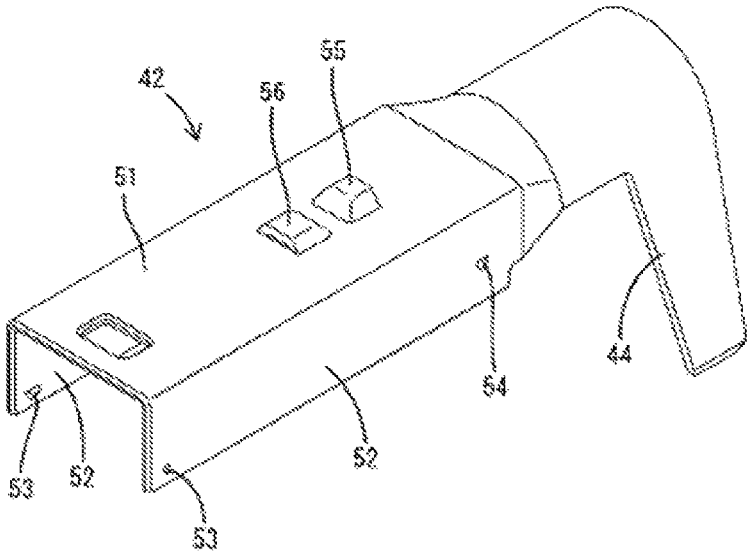
FIG. 13 is a perspective view of the second shell in a vertically inverted state.

The first housing 10 is made of synthetic resin and, as shown in FIGS. 7 and 8, is a single component including an accommodating portion 11 and a tubular fitting 12 extending forward from the outer periphery of the accommodating portion 11 and surrounding the accommodating portion 11 over the entire periphery. A first accommodation chamber 13 is formed inside the accommodating portion 11. The shield terminal 30 is inserted into the accommodation chamber 13 from behind the first housing 10. A first locking lance 14 is cantilevered forward from an inner upper surface of the first accommodation chamber 13 and is resiliently deflectable upward. A step-like first stopper 15 is formed on an inner lower surface of the first accommodation chamber 13.

Figure 6:
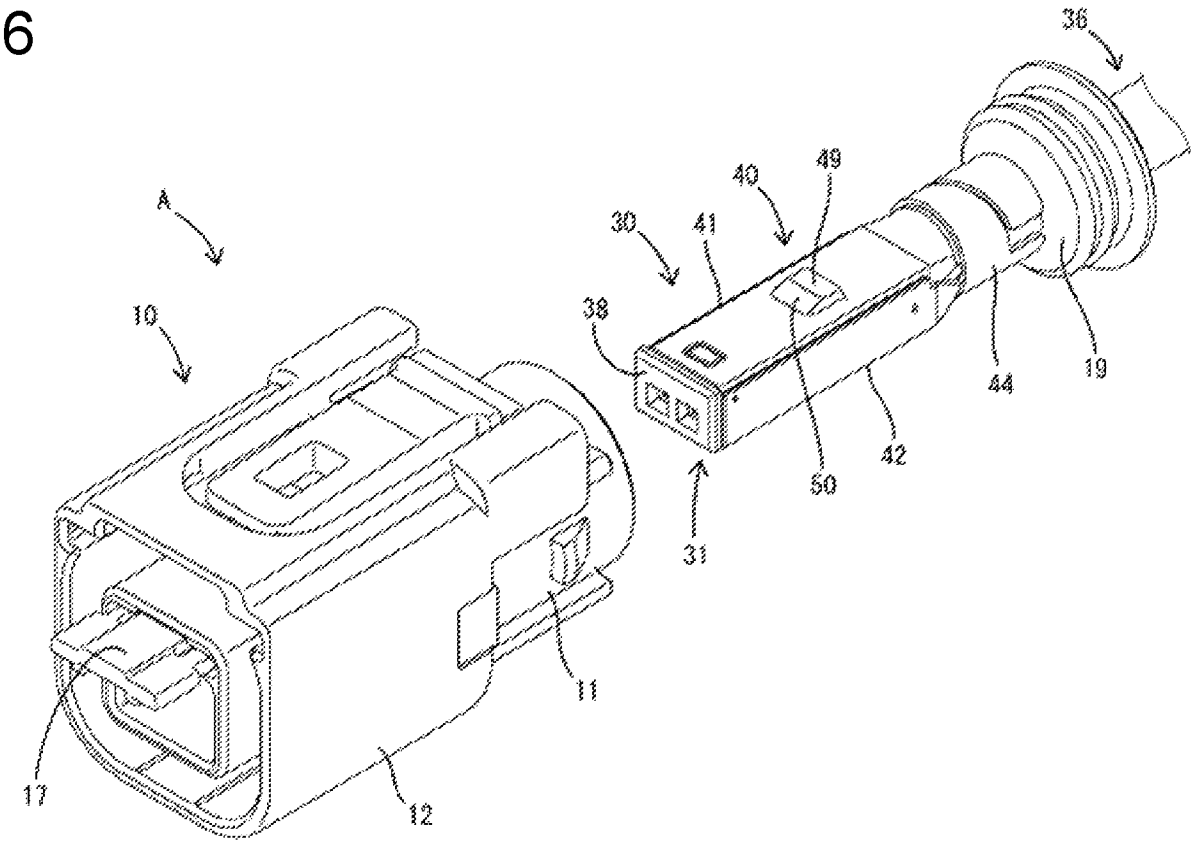
FIG. 6 is a perspective view showing a state where a first housing and the shield terminal are separated in a first shield connector.

The accommodating portion 11 is formed with a deflection space 16 for allowing the first locking lance 14 to be deflected resiliently upward. A front retainer 17 is mounted into the accommodating portion 11 from the front of the first housing 10. The front retainer 17 mounted in the accommodating portion 11 is movable in the front-rear direction between a partial locking position where the front retainer 17 is forward of the deflection space 16 to allow the resilient deflection of the first locking lance 14, as shown in FIGS. 6 and 8, and a full locking position where the front retainer 17 enters the deflection space 16 to restrict the resilient deflection of the first locking lance 14, as shown in FIG. 7.

The deflection space 16 is not open in the outer peripheral surface of the accommodating portion 11 and is open in the front surface of the accommodating portion 11. Further, a seal ring 18 is mounted on a rear part of the outer periphery of the accommodating portion 11. When a receptacle-like mating housing (not shown) is fit between the outer periphery of the accommodating portion 11 and the inner periphery of the tubular fitting 12, a gap between the accommodating portion 11 and the mating housing is waterproofed by the seal ring 18.

Figure 1:
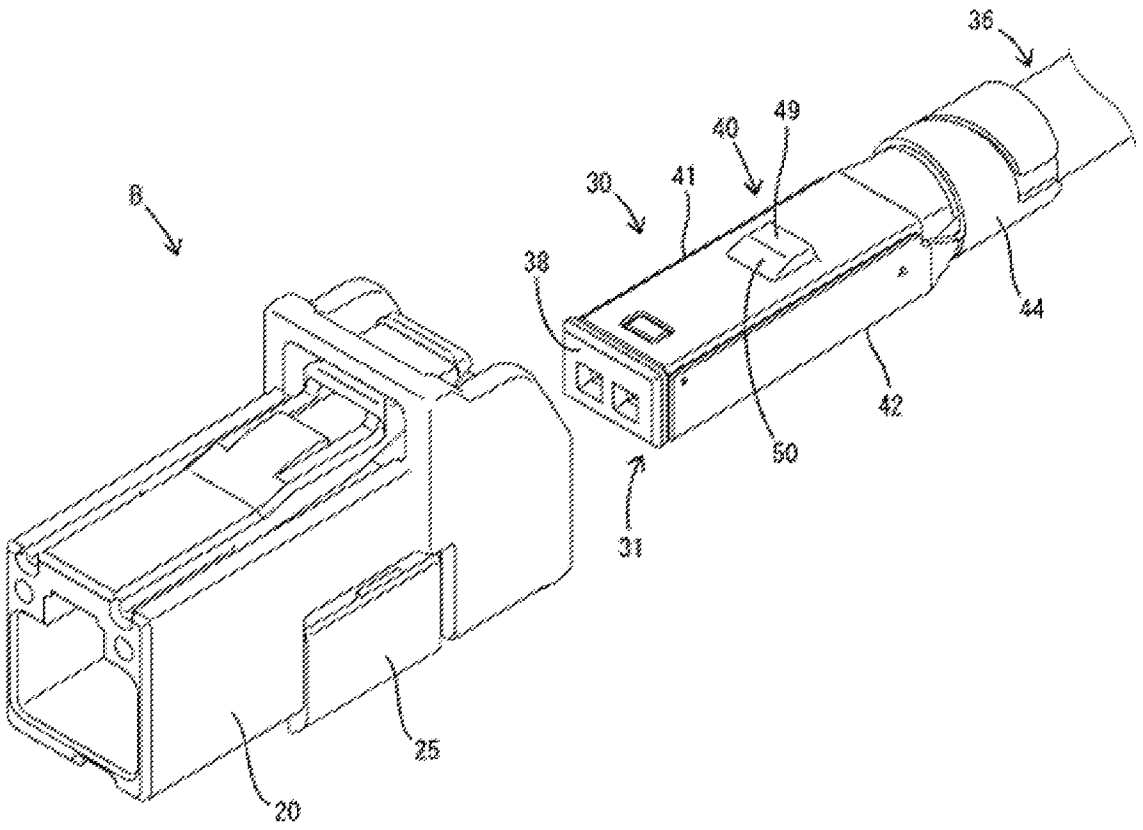
FIG. 1 is a perspective view showing a state where a second housing and a shield terminal are separated in a second shield connector of one embodiment when viewed obliquely from above.
Figure 2:
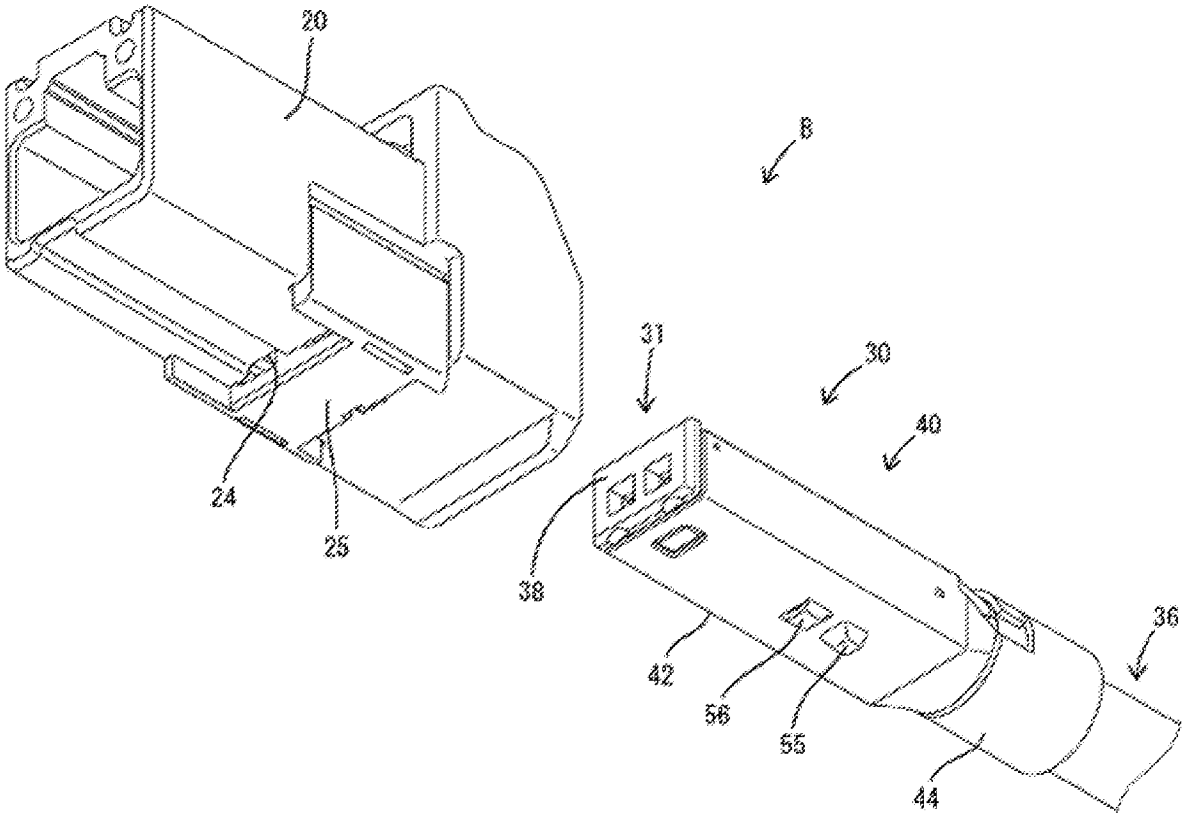
FIG. 2 is a perspective view showing the state where the second housing and the shield terminal are separated in the second shield connector when viewed obliquely from below.
Figure 3:
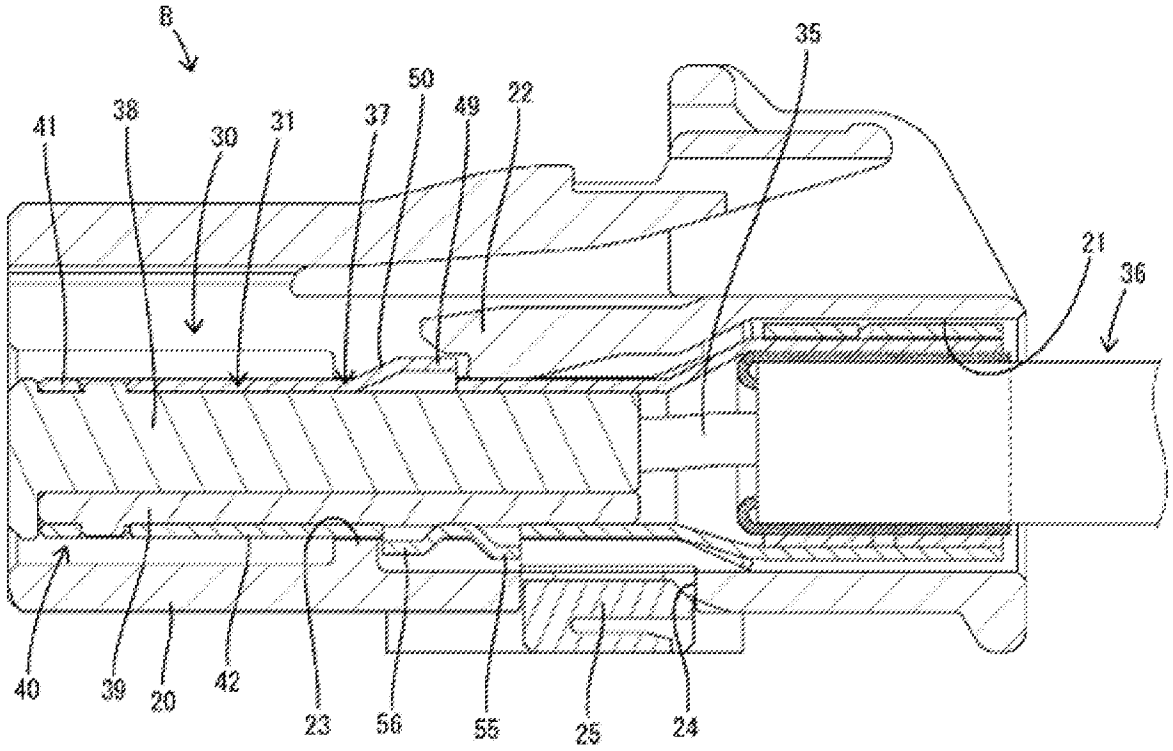
FIG. 3 is a side view in section showing a state where a side retainer is at a partial locking position in the second shield connector.
Figure 4:
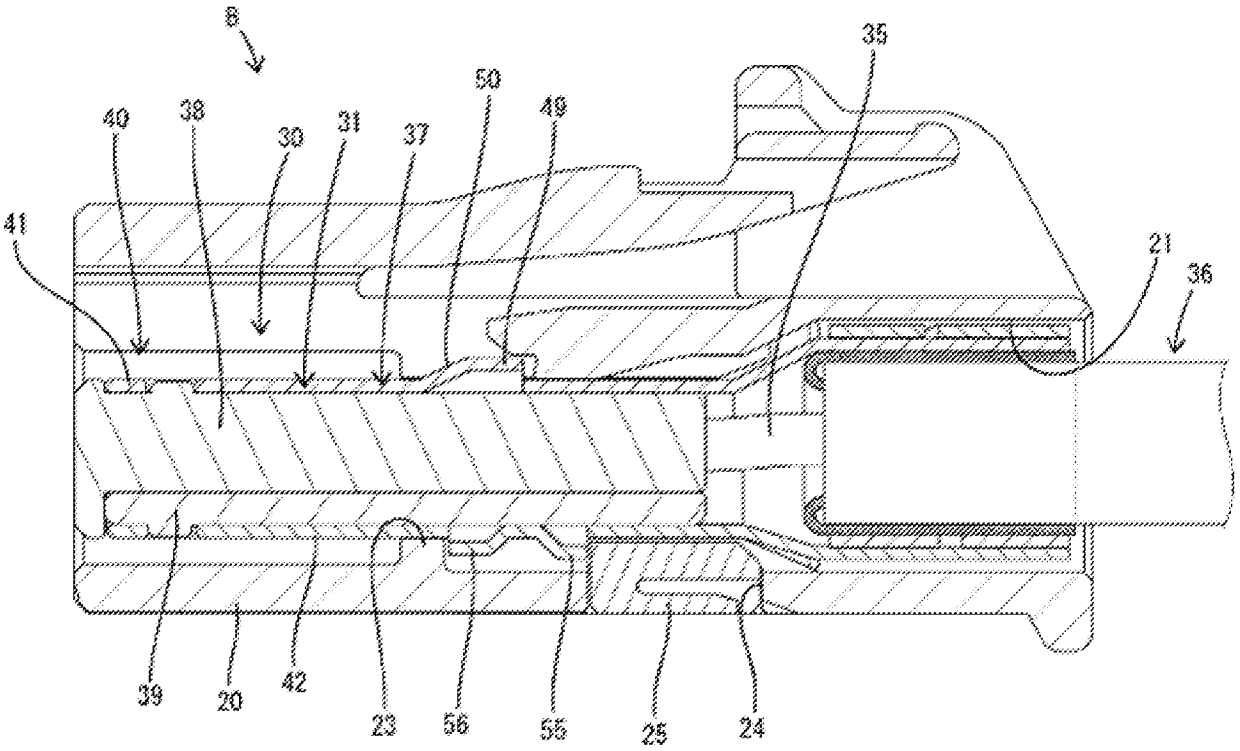
FIG. 4 is a side view in section showing a state where the second shield connector is at a full locking position in the second shield connector.
Figure 5:
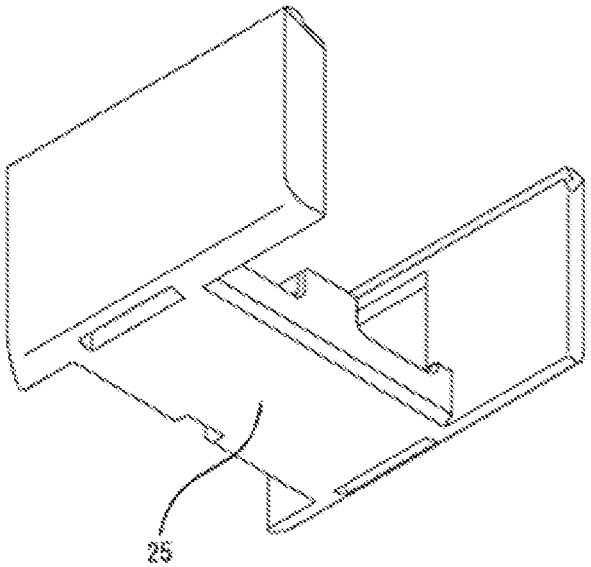
FIG. 5 is a perspective view of the side retainer.

The second housing 20 is made of synthetic resin. As shown in FIGS. 3 and 4, a second accommodation chamber 21 is formed inside the second housing 20. The shield terminal 30 is inserted into the second accommodation chamber 21 from behind the second housing 20. A second locking lance 22 is cantilevered forward from an inner upper surface of the second accommodation chamber 21 and is resiliently deflectable upward. A step-like second stopper 23 is formed on an inner lower surface of the second accommodation chamber 21.

A mounting hole 24 is formed through the lower surface of the second housing 20 is formed with a mounting hole 24 communicates with the inside of the second accommodation chamber 21. A side retainer 25 is mounted into the mounting hole 24 and is movable in the vertical direction (direction intersecting an inserting/withdrawing direction of the shield terminal 30 into and from the second accommodation chamber 21) between a partial locking position where the side retainer 25 is retracted to the outside of the second accommodation chamber 21, as shown in FIG. 3, and a full locking position where the side retainer 25 is located in the accommodation chamber 21, as shown in FIG. 4.

The shield terminal 30 is a connecting member constituting a wiring harness for Ethernet (registered trademark) high-speed communication circuit of an automotive vehicle. The shield terminal 30 has a terminal unit 31 surrounded by a rectangular tubular outer conductor 40 made of a metal material. The terminal unit 31 is configured by accommodating two inner conductors 32 into a dielectric 37.

The inner conductor 32 is long in the front-rear direction and has a rectangular tubular body 33 formed in a front end part of the inner conductor 32. A tab-like mating conductor (not shown) is inserted into the body 33 from the front of the inner conductor 32, and the mating conductor and the inner conductor 32 are connected conductively. A front part of a wire 35 is fixed conductively to a crimping portion 34 in the form of an open barrel formed in a rear end part of the inner conductor 32. Two of the wires 35 connected to two inner conductors 32 constitute a twisted pair cable 36. The dielectric 37 is configured by vertically uniting a first component 38 made of synthetic resin and having a halved shape and a second component 39 made of synthetic resin and having a halved shape.

The outer conductor 40 is configured by uniting a first shell 41 having a halved shape and a second shell 42 having a halved shape to sandwich the terminal unit 31 therebetween. First and second barrels 43, 44 formed on a rear end part of the outer conductor 40 are conductively fixed to a braided wire 45 of the twisted pair cable 36. The shield terminal 30 fixed to the twisted pair cable 36 is mounted into the first housing 10 and the second housing 20 by being inserted therein from behind.

The first shell 41 includes an upper plate 46 elongated in the front-rear direction, left and right locking pieces 47 extending down from front end parts of both left and right side edges of the upper plate 46 and two lock pieces 48 extending down from rear end parts of the left and right side edges of the upper plate 46. The first barrel 43 is an open barrel formed in a rear end part of the first shell 41.

A projection-like first locking portion 49 is formed integrally on the upper surface (outer surface) of the upper plate 46. The first locking portion 49 is formed by cutting a part of the upper plate 46 and raising the cut part up. The first locking portion 49 is disposed in a substantially central part of the upper plate 46 in the front-rear direction and in a center of the upper plate 46 in a lateral direction. A front part of the first locking portion 49 is formed with an inclined surface 50 inclined with respect to the front-rear direction (inserting direction of the shield terminal 30 into the housing). A rear end surface of the first locking portion 49, which is a cut and raised surface, serves as a locking surface substantially at a right angle to the front-rear direction The second shell 42 includes a bottom plate 51 elongated in the front-rear direction and left and right side plates 52 extending down from left and right sides of the bottom plate 51. Left and right locking projections 53 are formed respectively on the inner surfaces of front end parts of the left and right side plates 52, and left and right lock projections 54 are formed respectively on the inner surfaces of rear end parts of the left and right side plates 52. The second barrel 44 in the form of an open barrel is formed in a rear end part of the second shell 42.

A second locking portion 55 and a front stopn 56 are formed on the lower surface (outer surface) of the bottom plate 51. The second locking portion 55 is formed by cutting a part of the bottom plate 51 and raising the cut part. A rear end surface of the second locking portion 55, which is a cut and raised surface, serves as a locking surface and is substantially at a right angle to the front-rear direction. The second locking portion 55 is at a position behind a center of the bottom plate 51 in the front-rear direction and is at a center position of the bottom plate 51 in the lateral direction.

The front stop 56 is formed by cutting a part of the bottom plate portion 51 and raising the cut part. A front surface of the front stop 56, which is a cut and raised surface, serves as a front stop surface substantially at a right angle to the front-rear direction. The front stop 56 is at a position in front of and near the second locking portion 55 in the front-rear direction and is at a center position of the bottom plate 51 in the lateral direction.

In assembling the first shell 41 and the second shell 42, the first shell 41 and the second shell 42 are united by placing the locking pieces 47 and 48 of the first shell 41 along the inner surfaces of the side plates 52 of the second shell 42. The united first and second shells 41 and 42 are held united by the locking of the locking pieces 47 and the locking projections 53 and the locking of the lock pieces 48 and the lock projections 54. An assembling direction of the first and second shells 41 and 42 is substantially perpendicular to the axes of the front end parts of the wires 35. When the first and second shells 41 and 42 are united, the outer conductor 40 is configured, and the terminal unit 31 is assembled in a state accommodated in the outer conductor 40 to complete the assembling of the shield terminal 30.

In mounting the shield terminal 30 into the first housing 10, a rubber plug 19 is mounted on the outer periphery of the twisted pair cable 36 in advance and the shield terminal 30 is inserted into the first accommodation chamber 13 from behind the first housing 10 with the front retainer 17 held at the partial locking position. In the process of inserting the shield terminal 30, the inclined surface 50 of the first locking portion 49 resiliently deflects the first locking lance 14.

When the shield terminal 30 is inserted properly, the front stop 56 butts against the first stopper 15 to stop the shield terminal 30 in front and the first locking portion 49 is locked to the first locking lance 14 to retain the shield terminal 30 with respect to the first housing 10. Further, the rubber plug 19 closses an opening on the rear end of the first accommodation chamber 13 in a liquid-tight manner so that the shield terminal 30 is at a primary locked state.

After the shield terminal 30 is inserted properly, the front retainer 17 at the partial locking position is pushed to the full locking position to enter the deflection space 16 to restrict resilient deflection of the first locking lance 14 in a direction separating from the first locking portion 49 and to achieve secondary locking of the shield terminal 30. As just described, the shield terminal 30 is retained reliably by primary locking by the first locking lance 14 and secondary locking by the front retainer 17.

In mounting the shield terminal 30 into the second housing 20, the shield terminal 30 is inserted into the second accommodation chamber 21 with the side retainer 25 held at the partial locking position. In the process of inserting the shield terminal 30, the inclined surface 50 of the second locking portion 49 resiliently deflects the second locking lance 22. When the shield terminal 30 is inserted properly, the front stop 56 butts against the second stopper 23 to stop the shield terminal 30 in front, and the first locking portion 49 is locked to the second locking lance 22 to retain the shield terminal 30 with respect to the second housing 20. Thus, the shield terminal 30 achieves a primary locked state.

After the shield terminal 30 is inserted properly, the side retainer 25 at the partial locking position is pushed to the full locking position to enter the second accommodation chamber 21. In this way, the side retainer 25 is locked to the second locking portion 55 from behind and the shield terminal 30 achieves a secondary locked state. As just described, the shield terminal 30 is reliably retained by primary locking by the second locking lance 22 and secondary locking by the side retainer 25.

The first shield connector A of this embodiment is configured by inserting the shield terminal 30 having the terminal unit 31 accommodated in the outer conductor 40 into the first accommodation chamber 13 formed in the first housing 10. Further, the second shield connector B is configured by inserting the shield terminal 30 into the second accommodation chamber 21 formed in the second housing 20. That is, the shield terminal 30 is mounted selectively into the first housing 10 or the second housing 20. In other words, the shield terminal 30 can be mounted into either of the first housing 10 and the second housing 20 and is mounted into either one of the first housing 10 and the second housing 20 according to need.

The first housing 10 includes the resiliently deflectable first locking lance 14, the front retainer 17 capable of restricting the resilient deflection of the first locking lance 14 and the first accommodation chamber 13. The second housing 20 includes the resiliently deflectable second locking lance 22, the second accommodation chamber 21 and the side retainer 25 facing the inside of the second accommodation chamber 21.

The first locking portion 49 and the second locking portion 55 are formed on the outer surface of the outer conductor 40. With the shield terminal 30 inserted in the first accommodation chamber 13, the first locking portion 49 is locked to the first locking lance 14 and the front retainer 17 restricts the resilient deflection of the first locking lance 14 so that the shield terminal 30 is retained reliably. Further, with the shield terminal 30 inserted in the second accommodation chamber 21, the shield terminal 30 is retained reliably by the locking of the first locking portion 49 and the second locking lance 22 and the locking of the second locking portion 55 and the side retainer 25.

As just described, the reliability of a function for retaining the shield terminal 30 of this embodiment is excellent regardless of whether the shield terminal 30 is mounted into the first housing 10 or the second housing 20. Further, the shield terminal 30 can be used as a common member for the waterproof first housing 10 and the non-waterproof second housing 20, which are of different types.

Further, the first locking portion 49 and the second locking portion 55 are disposed in regions of the outer surface of the outer conductor 40 on opposite sides in the vertical direction intersecting the inserting direction into the first accommodation chamber 13 and the second accommodation chamber 21. According to this configuration, the disposition of the first locking portion 49 and the second locking portion 55 in different regions achieves a high degree of freedom in design, such as the shapes and arrangements of the first locking portion 49 and the second locking portion 55.

Further, the front stop 56 configured to restrict a movement of the shield terminal 30 inserted into the first or second accommodation chamber 13 or 21 beyond a proper insertion position is formed in the region (outer surface of the bottom plate 51) of the outer surface of the outer conductor 40 where the second locking portion 55 is disposed. According to this configuration, the first locking lance 14 and the second locking lance 22 do not resiliently contact the region (outer surface of the bottom plate 51) where the second locking portion 55 is formed, even if the front stop 56 is formed, insertion resistance due to the resilient interference of the front stop 56 with the first locking lance 14 or the second locking lance 22 is not generated.

The invention is not limited to the above described and illustrated embodiment. For example, the following embodiments also are included in the scope of the invention.

Although the first and second locking portions are disposed in the regions of the outer surface of the outer conductor on the sides opposite to each other in the above embodiment, the first and second locking portions may be disposed on the same plane of the outer surface of the outer conductor.

Although only one first locking portion is provided in the above embodiment, two or more first locking portions may be provided.

Although only one second locking portion is provided in the above embodiment, two or more second locking portions may be provided.

Although only one front stop portion is provided in the above embodiment, two or more front stop portions may be provided.

Although the second locking portion and the front stop portion are in the form of independent projections in the above embodiment, the second locking portion and the front stop portion may be integrally formed into one projection.

Although two inner conductors are accommodated into one dielectric in the above embodiment, one, three or more inner conductors may be accommodated into one dielectric.

Although the outer conductor is composed of two components, i.e. the first and second shells, in the above embodiment, the outer conductor may be composed of a single component.

Although two wires connected to the pair of inner conductors constitute the twisted pair cable in the above embodiment, the present invention can be applied also when a wire connected to an inner conductor does not constitute a twisted pair cable.

LIST OF REFERENCE SIGNS

A . . . first shield connector (shield connector)
B . . . second shield connector (shield connector)
10 . . . first housing
13 . . . first accommodation chamber
14 . . . first locking lance
17 . . . front retainer
20 . . . second housing
21 . . . second accommodation chamber
22 . . . second locking lance
25 . . . side retainer
30 . . . shield terminal
32 . . . inner conductor
37 . . . dielectric
40 . . . outer conductor
49 . . . first locking portion
55 . . . second locking portion
56 . . . front stop portion

The invention claimed is:

1. A shield terminal, comprising:

an inner conductor;

a dielectric configured to accommodate the inner conductor; and an outer conductor surrounding the dielectric, the shield terminal being selectively mountable into a selected one of a first housing including a resiliently deflectable first locking lance, a front retainer capable of restricting resilient deflection of the first locking lance and a first accommodation chamber and a second housing including a resiliently deflectable second locking lance, a second accommodation chamber and a side retainer facing inside of the second accommodation chamber, wherein:

a first locking portion and a second locking portion are formed on an outer surface of the outer conductor;

the shield terminal is retained by the front retainer restricting the resilient deflection of the first locking lance and the first locking portion being locked to the first locking lance with the shield terminal inserted in the first accommodation chamber; and the shield terminal is retained by locking of the first locking portion and the second locking lance and locking of the second locking portion and the side retainer with the shield terminal inserted in the second accommodation chamber.

2. The shield terminal of claim 1, wherein the first locking portion and the second locking portion are disposed in regions of the outer surface of the outer conductor on opposite sides in a direction intersecting an inserting direction into the first accommodation chamber and the second accommodation chamber.

3. The shield terminal of claim 2, wherein a front stop configured to restrict a movement of the shield terminal inserted into the first accommodation chamber or the second accommodation chamber beyond a proper insertion position is formed in the region of the outer surface of the outer conductor where the second locking portion is disposed.

4. A shield connector configured by selectively inserting a shield terminal having an inner conductor accommodated in a dielectric and having the dielectric surrounded by an outer conductor into a sected one of a first accommodation chamber formed in a first housing and a second accommodation chamber formed in a second housing, comprising:

a resiliently deflectable first locking lance formed in the first accommodation chamber;

a front retainer configured to restrict resilient deflection of the first locking lance by being mounted into the first housing;

a resiliently deflectable second locking lance formed in the second accommodation chamber;

a side retainer mounted into the second housing to face inside of the second accommodation chamber;

a first locking portion formed on an outer surface of the outer conductor and configured to retain the shield terminal by being locked to the first locking lance when the shield terminal is inserted into the first accommodation chamber and to retain the shield terminal by being locked to the second locking lance when the shield terminal is inserted into the second accommodation chamber; and a second locking portion formed on the outer surface of the outer conductor and configured to retain the shield terminal by being locked to the side retainer when the shield terminal is inserted into the second accommodation chamber.

* * * * *